United States Patent [19]

Kendrick et al.

[11] Patent Number: 4,598,912

[45] Date of Patent: Jul. 8, 1986

[54] SPORTING CRIBBAGE GAME

[76] Inventors: Marjorie A. Kendrick; William M. Kendrick, both of P.O. Box 124, Eaton, N.H. 03832

[21] Appl. No.: 654,970

[22] Filed: Sep. 27, 1984

[51] Int. Cl.[4] ..... A63F 3/00

[52] U.S. Cl. ..... 273/245; 273/248

[58] Field of Search ..... 273/148 R, 148 A, 248, 273/245, 259, 277, 244, 287

[56] References Cited

U.S. PATENT DOCUMENTS

| | | | |
|---|---|---|---|
| 1,635,489 | 7/1927 | McColm | 273/245 |
| 1,736,523 | 11/1929 | Decker | 273/245 |
| 2,075,354 | 6/1935 | Mouier | 273/287 |
| 4,277,065 | 7/1981 | White | 273/245 |

OTHER PUBLICATIONS

Directions for Cribbage; Milton Bradley Company, Springfield, Mass.

*Primary Examiner*—Richard C. Pinkham
*Assistant Examiner*—Benjamin Layno
*Attorney, Agent, or Firm*—Daniel H. Kane, Jr.

[57] ABSTRACT

An improved cribbage game having a gameboard formed with the graphic representation of a sporting course such as a golf course having a plurality of fairways, each beginning with a tee and culminating in a green and golf hole. The rows of cribbage game peg-holes for scoring points are in the form of non-linear tracks following the fairways through the golf course. The non-linear tracks include a plurality of detours from the tracks starting from a sporting obstacle peghole on the track and terminating at a return peghole on the track with at least one additional off-track peghole in between. In the example of a golf course, the detours represent golfing obstacles or hazards. The additional off-track pegholes are followed by the pegs of players when the pegs stop in a sporting obstacle peghole after scoring and tallying the points. A set of supplemental sporting rules supplement the rules of cribbage specifying that players must follow a detour when pegs of players stop in a sporting obstacle peghole and that a player who first completes a respective track through the course wins the game.

20 Claims, 5 Drawing Figures.

SPORTING CRIBBAGE GAME

TECHNICAL FIELD

This invention relates to a new recreational game played with cards and a gameboard and in particular to an improved cribbage game.

BACKGROUND ART

The game of cribbage combines use of deck of cards for playing cribbage card hands and earning points according to the rules of cribbage with a simple gameboard formed with at least two rows of pegholes for scoring and tallying points earned from play of cribbage card hands by moving pegs along the respective rows of pegholes. The purpose of the gameboard, however, is simply to tally the points and identify the winner as the first player to complete progress through a row or sequence typically consisting of 121 pegholes. The use of the peghole scoring gameboard does not involve any gaming strategy which is limited in conventional cribbage to the manner of playing the cribbage card hands. The rules of cribbage in playing and scoring the hands are described in the directions and instructions for cribbage published by any of the many manufacturers of cribbage games such as Milton Bradley Company of Springfield, Mass.

OBJECTS OF THE INVENTION

It is an object of the present invention to provide an improved cribbage game with a novel gameboard in which the use of the gameboard is incorporated as an integral part of the gaming strategy.

Another object of the invention is to provide an improved cribbage game of interest to sporting enthusiasts such as golfers which combines conventional rules of cribbage with elements of selected sports such as the game of golf.

A further object of the invention is to provide an improved cribbage game with a colorful gameboard depicting a sporting course, which in the case of a golf course may bear the likeness and portray the landscape of an actual selected golf course, for adding variety to the conventional game of cribbage, incorporating gameboard strategy with the play of cribbage card hands, and combining features of selected sports such as golf with cribbage.

DISCLOSURE OF THE INVENTION

In order to accomplish these results, the invention provides an improved cribbage game similar to conventional cribbage in using a deck of cards for playing cribbage card hands and earning points according to the rules of cribbage, a gameboard formed with at least two rows of a specified number of pegholes for respectively scoring the points earned from play of cribbage card hands by at least two players, and pegs for tallying points on the gameboard by counting holes and moving pegs along respective rows of pegholes according to the earned points until one of the players earns sufficient points to complete a row or sequence of pegholes thereby winning the game.

According to the present invention, however, the gameboard is formed with the graphic representation of a sporting course for a selected sport such as a golf course comprising, for example, a plurality of fairways, each beginning with a tee and culminating in a green and golf hole. The rows of pegholes in the gameboard of the present invention comprise non-linear tracks following the fairways through the golf course and the tracks are divided into fairway sections, each section beginning at a tee, following the fairway, and having the respective golf hole of the green as the last peghole of a fairway section.

The invention further provides that the non-linear tracks through the sporting course include a plurality of detours from the tracks, each detour in the example of a golf course starting from a golfing obstacle peghole on the track and terminating at a return peghole on the track with at least one additional off-track peghole in between. The gameboard is formed with graphic representations of golfing obstacles or hazards such as sand traps, water hazards, trees, golf-balls-in-the-rough, and missed putts, coinciding with the detours.

A feature and advantage of the gameboard presentation according to the invention is that additional off-track pegholes are added to the course followed by the pegs of players when pegs stop in a sporting obstacle peghole after scoring and tallying the points earned from play of a cribbage card hand thereby retarding progress of the pegs through the gameboard. As a result of this active intervention of the gameboard in the progress of the game, use of the gameboard is best incorporated as an integral part of the gaming strategy along with the play of cribbage card hands, and the play of cribbage card hands must be modified to accommodate the novel configuration of the gameboard in order, for example, to avoid sporting obstacle pegholes.

The invention contemplates a set of supplemental rules supplementing the rules of cribbage and specifying that players must follow a detour when pegs of players stop in a sporting obstacle peghole upon scoring and tallying the points earned from play of a cribbage card hand. The player who first completes a respective track through the golf course wins the game. Other supplemental golfers rules incorporated in the improved cribbage game include automatically scoring a bonus point, deemed a "birdie", and advancing the peg to the tee of the next fairway section if the peg of a player stops in a golf hole upon scoring and tallying the points earned from play of a cribbage card hand. Furthermore, if a player earns no points from play of a cribbage card hand, it is deemed a "lost ball" and the player receives two negative penalty points and the peg of the player must be moved two pegholes back. Other rules are also provided.

Appropriately, according to the invention the pegs for tallying points along the tracks of pegholes through the golf course are golfer's golftees.

A number of additional features and variations in the gameboard configuration and supplemental golfer's rules incorporated in the improved cribbage game are contemplated by the invention. For example, the golf course graphically depicted on the gameboard may be a representation and likeness of the landscape characteristics of an actual selected golf course, such as, for example, the Pebble Beach Golf Course. The gameboard may be incorporated in table tops such as, for example, game tables or card tables and in benches or other pieces of furniture. The gameboard may closely follow the rules of conventional cribbage in certain respects while incorporating the graphic representation of the golf course, golfing hazards and obstacles, and supplemental golfer's rules. For example, the peghole tracks through the golf course may each extend a specified length of, for example, 121 pegholes as in conventional cribbage and identically incorporate the rules for the playing and scoring of cribbage card hands. On the other hand, the invention provides a new method for playing cribbage in the manner and with the modifications set forth above and described hereafter in further detail with reference to the drawings.

More generally, the invention contemplates providing a gameboard formed with the graphic representation thereon of a sporting course for a selected sport and further providing the non-linear tracks through the course with a plurality of detours from the tracks, each detour starting from a sporting obstacle peghole on the track and terminating at a return peghole on the track with at least one additional off-track peghole in between, said gameboard being formed with graphic representations of sporting obstacles or hazards characteristic of the selected sport coinciding with the detours. Furthermore, supplemental rules are provided characteristic of the selected sport. The invention contemplates a variety of sporting cribbage game applications including not only a Golfers Cribbage game but also a Skiers Cribbage game, Yachters Cribbage game, etc.

DESCRIPTION OF PREFERRED EXAMPLE EMBODIMENTS AND BEST MODE OF THE INVENTION

Figure 1:
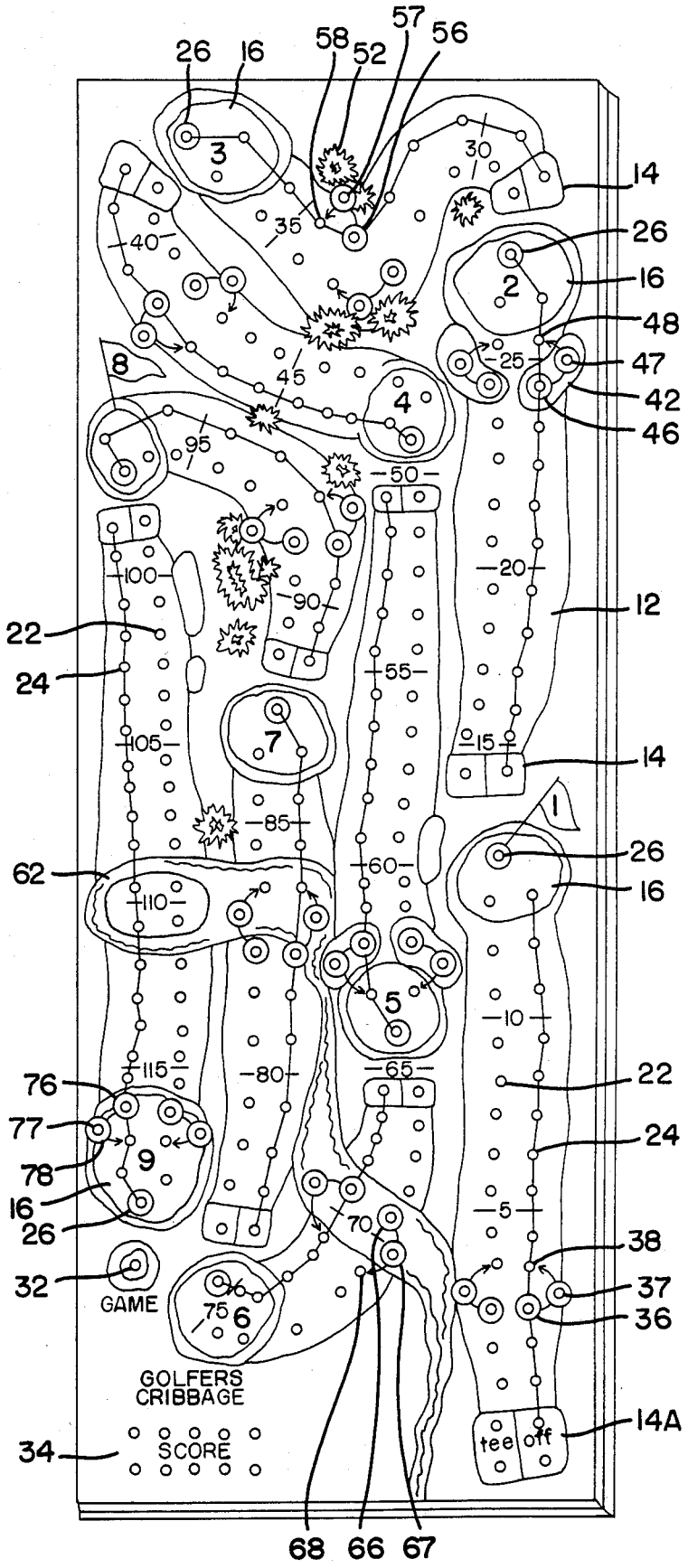
FIG. 1 is a diagrammatic plan view of a gameboard in accordance with the invention for playing the Golfers Cribbage game.

A gameboard for a Golfers Cribbage game in accordance with the present invention is illustrated in FIG. 1. Overall, the gameboard is formed with the graphic representation of a golf course, in this example, a nine hole golf course with nine fairways 12. Each fairway 12 begins with a tee 14 and culminates in a green 16 and golf cup or golf hole cup 26, referred to herein as the golf hole 26. Each of the successive greens 16 and golf holes 26 are consecutively numbered 1 thru 9 indicating the order of progression through the nine hole golf course.

Two rows of peg holes 22 and 24 forming non-linear tracks follow the fairways through the golf course. The non-linear tracks or rows of peg holes 22 and 24 are divided into fairway sections corresponding to each of the fairways 12, each section of non-linear tracks beginning at a tee 14, following the respective fairway 12, and ending in a single golf hole 26 in the green 16 at the end of the respective fairway. Thus, while each tee 14 provides separate holes for the two tracks or rows of pegholes 22 and 24, the two rows merge into a single golf hole 26 at the green 16. The initial tee **14*a* for the first fairway and golf hole provides two pegholes in each of the rows 22 and 24** for holding the two scoring pegs of each of the players in a two-person Golfers Cribbage game or for each of the teams in a four-person Golfer's Cribbage game.

Figure 5:
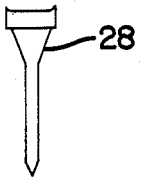
FIG. 5 is a side view of a golftee peg according to the invention.

While the example of FIG. 1 provides two rows of pegholes 22 and 24, it is apparent that the gameboard can be easily modified for a three-person or six-person Golfers Cribbage game by providing three parallel rows of non-linear tracks for three sets of scoring pegs. In either event, the invention provides golfer's tees 28 for the scoring pegs in keeping with the theme of the game as illustrated in FIG. 5.

A careful inspection of the gameboard of FIG. 1 reveals scoring lines or tallying lines in units of five pegs each along the tracks 22 and 24 designated by the spaced numerals 5, 10, 15, 20, etc. thru the entire golf course. The scoring lines or tallying lines facilitate the counting and progress of scoring pegs along the tracks during game play. It is noted that as scoring progress is made through the golf course along the respective fairways while scoring the points earned from play of cribbage card hands, each of the scoring pegs remains in its own respective rows or tracks 22 and 24 except at the golf holes 26 which functions as a peghole for both rows. Thus, the golf holes 26 are counted as one of the holes in each of the tracks 22 and 24 during counting and scoring progress along the tracks.

In the example of FIG. 1 the last scoring line or tallying line 115 is found in the ninth fairway before the ninth green 16. The last scoring line or tallying line 115 is followed by five holes culminating in the ninth hole 26 for a total of 120 holes in each track through the ninth hole. The ninth hole and fairway is followed by the game completion hole 32 which provides a final hole for each of the tracks 22 and 24 for a total of 121 scoring pegholes in each track or row corresponding to the 121 winning points in traditional cribbage. The additional pegholes 34 provide locations for storing additional golfer's tees for use as scoring pegs.

In summary, as illustrated in the embodiment of the invention of FIG. 1, each of the two rows of pegholes 22 and 24 is arranged to provide or define a separate identifiable and continuous sequence of cribbage scoring pegholes on the cribbage gameboard from a starting peghole at the tee of the first fairway to the game completion hole at the end of the last fairway. In other words, each row provides an identifiable unique track throughout the gameboard and contains or comprises 121 cribbage scoring pegholes for scoring and tallying the points from the beginning to the end of the cribbage game.

Throughout the golf course a number of detours are provided from the non-linear tracks 22 and 24, at least one detour in each of the fairways. The detours represent characteristic golfing obstacles or hazards adding additional off-track pegholes to the course followed by the pegs of players in the rows or tracks 22 and 24. The detours therefore retard progress of the pegs through the gameboard and impede the accumulation of the necessary 121 points for victory represented by the pegholes within the non-linear tracks 22 and 24. Thus, while each of the pegholes within the non-linear tracks 22 and 24 represents a scoring point, the off-track pegholes in the detours do not count as scoring points toward the accumulation of the necessary 121 cribbage points required to win a traditional cribbage game. The detours represent a number of golfing obstacles and hazards such as sand traps, water hazards, golf-ball-in-the-rough, missed putts, trees and shrubs, etc.

For example, referring to the first fairway leading to the first hole there is provided a detour representing a golf ball in the rough. The golf-ball-in-the-rough obstacle or detour starts from a golfing obstacle peghole 36 located in the respective tracks 22 and 24, detours to an off-track peghole 37 and ends at a return peghole 38, again located in each of the respective tracks 22 and 24.

In this example the golf-ball-in-the-rough golfing obstacle or hazard represented by the detour adds one additional off-track peghole 37 to the course followed by the pegs of players. It is apparent, however, that additional off-track pegholes greater than one may be included in the detour.

Figure 2:
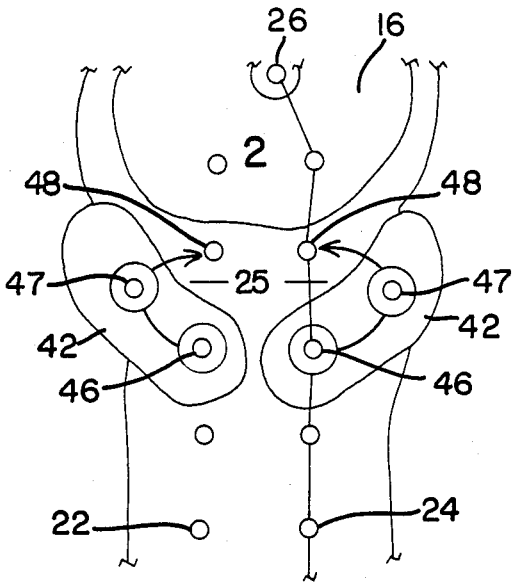
FIGS. 2–4 are detailed fragmentary diagrammatic views of portions of the gameboard showing golfing obstacles or hazards.
Figure 3:
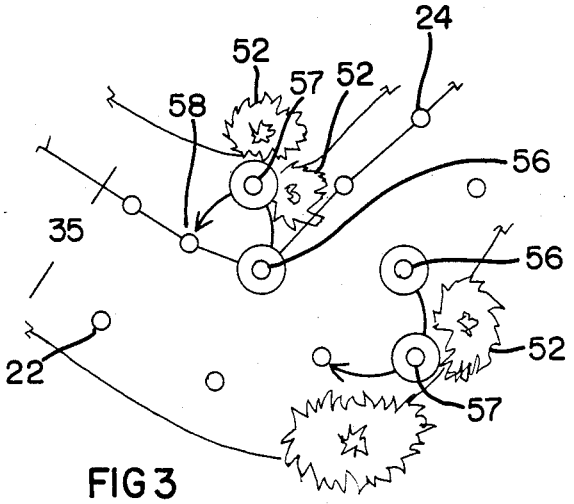

In the example of the second fairway 12 leading to the second hole the detour represents a sand trap 42 in each track or row beginning with the starting obstacle peghole or starting sand trap peghole 46 in each of the tracks or rows 22 and 24 leading to a single off-track sand trap peghole 47 and returning to the return peghole 48 in the respective rows or tracks 22 and 24 as shown in further detail in FIG. 2. The third fairway 12 leading to the third hole provides a detour representing a tree or shrub golfing obstacle 52 beginning with the starting obstacle peghole 56 in the respective tracks 22 and 24 leading to the off-track tree or bush obstacle peghole 57 and returning to the respective tracks 22 and 24 at the on-track peghole 58 as shown in further detail in FIG. 3.

Figure 4:
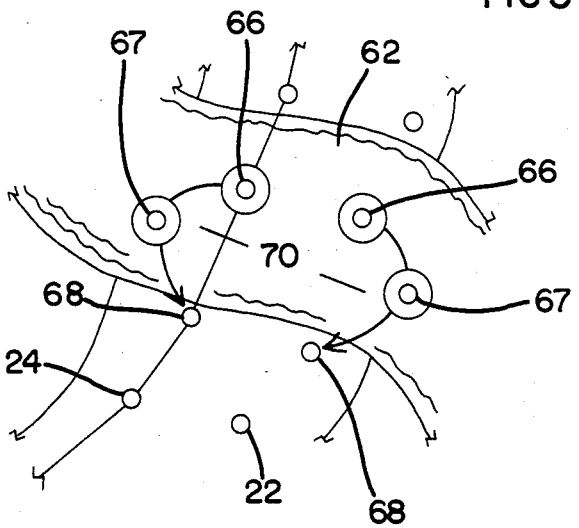

The fourth fairway and fourth hole repeats the golf-ball-in-the-rough golfing hazard and detour while the fifth fairway and fifth hole repeats the sand trap obstacle and detour. The sixth and seventh fairways leading to the sixth and seventh holes include detours for water hazards presented by stream 62. The detour consists in the starting water hazard peghole 66 leading to the off-track water hazard peghole 67 and returning to the respective tracks or rows 22 and 24 at return pegholes 68 as shown in further detail in FIG. 4.

The eighth fairway and eighth hole repeats the tree or shrub golfing obstacle detour while the ninth fairway and ninth hole introduces a putting obstacle on the ninth green 16. The putting obstacle on the green itself begins with the starting putting peghole 76 leading to the off-track putting obstacle peghole 77 and returning to the respective tracks or rows 22 and 24 at the peghole 78 in the ninth green.

According to the present invention points are earned by play of cribbage card hands according to the traditional rules of cribbage, for example, as set forth in the *Rules of Cribbage,* published by Milton Bradley Company of Springfield, Mass. However, the present invention provides additional rules for tallying and scoring the points on the gameboard according to the invention so that the game board for a Golfers Cribbage game is incorporated as an integral part of the gaming strategy along with the play of cribbage card hands. As a result the direction of play of the cribbage card hands by players may be modified to accommodate the novel configuration of the gameboard in order, for example, to avoid golfing obstacle pegholes in the respective rows or tracks 22 and 24.

According to the supplemental golfer's rules supplementing the rules of cribbage, players must follow a detour when pegs of the players stop in a golfing obstacle peghole upon scoring and tallying the points earned from play of a cribbage card hand. In starting the game the two golfer's tees representing the two scoring pegs for each player or team are placed in the available holes in the starting tee 14*a* of the first fairway and first hole for "tee off". Cribbage card hands are played according to the traditional rules and when scoring with a golfer's tee representing the golfer's peg stops in a golfing obstacle or golfing hazard peghole such as pegholes 36, 46, 56, 66, 76, etc., the player must follow the detour off the course to the one or more off-track obstacle pegholes on the next move. The golfing obstacle or golfing hazard pegholes 36, 46, 56, 66, 76, etc. in the respective tracks 22 and 24 may be accentuated by a red circle so that the detour requirement will not go unnoticed.

The golf hole 26 in each of the greens 16 at the end of each fairway section may be circled in white representing the cup. When the tally of points earned from a cribbage card hand actually ends with the peg or tee in a golf hole 26, the player is deemed to have achieved a "birdie" and scores an additional bonus point. The golfer's tee or scoring peg is therefore advanced to the tee 14 of the next fairway 12 in numerical order. If a player earns no points from play of a cribbage card hand or crib, it is deemed a "lost ball" and the player receives two negative penalty points. Therefore, the peg of the player must be moved two pegholes back. In scoring points, according to the traditional rules of cribbage, the reference herein to the play of cribbage card hands and the scoring of cribbage card hands is intended to include the points from the hand and crib as generally provided in the traditional rules of cribbage.

Another supplemental rule, according to the present invention, provides that if a player has not reached the tee of the eighth fairway section when his opponent wins the game, then he is deemed "skunked" designated a "duffer", and is scored as losing two games. Furthermore, if a player has not reached the tee of the sixth fairway section when his opponent wins the game, then he is "double skunked", designated a "double duffer", and is scored as losing three games.

A game of Golfers Cribbage, according to the present invention, is won by the first player to complete the nine holes after following one of the non-linear tracks or rows 22 or 24 through the golf course gameboard and then advancing from the ninth hole to the game completion peghole 32 at the end of the course. The winning player must therefore complete 121 tallying or scoring pegholes as in traditional cribbage. However, the player may also have completed a number of detours and a number of off-track pegholes in the course of completing the game and such off-track pegholes as heretofore described do not count in the tallying of 121 in-track or in-row pegholes. Rather, the off-track pegholes in the golfing obstacle and golfing hazard detours retard progress through the fairway sections of the golf course to a greater or lesser degree according to the number of off-track pegholes. However, the golfing obstacle and golfing hazard detours play an integral part in the strategy of play of the cribbage card hand so that scoring and tallying of points avoids the ending of a turn in a golfing obstacle or golfing hazard peghole. Thus, according to the present invention, the gameboard provides not only a colorful and interesting variation for scoring and tallying points but also through the supplemental rules of the present invention serves an integral part of the improved cribbage game affecting the strategy of play and scoring and tallying of cribbage card hands.

The invention also contemplates a number of additional features in the gameboard configuration and supplemental golfer's rules for incorporation in the improved game. For example, the golf course graphically depicted on the gameboard may be the representation and likeness of the detailed landscaped characteristics of an actual selected golf course of desired choice such as, for example, the Pebble Beach Golf Course or the golf course of a particular club or a particularly favorite golf course, etc. The gameboard may also be incorporated in table tops such as, for example, game tables, card tables, benches, and other pieces of furniture.

It is apparent that the present invention can be applied in a variety of sporting applications for sporting cribbage games. For example, the invention contemplates providing a Skiers Cribbage game for slalom or giant slalom skiing in which the gameboard is formed with the graphical representation of a slalom or giant slalom course with slalom gates along the course. The peghole scoring and tallying tracks or rows comprise non-linear tracks following the slalom or giant slalom course through a varied terrain. The non-linear tracks may be divided into sections corresponding to the various slalom gates placed through the course. Furthermore, a variety of sporting obstacles or hazards characteristic of slalom and giant slalom skiing are distributed through the course corresponding to detours from the tracks through off-track pegholes for retarding progress through the course. For example, the detours for a slalom Skiers Cribbage game may include a missed gate obstacle or hazard, off-course hazard, missed turn, a fall following a jump, a lost ski, an off-balance skier, a broken leg, etc. Similar rules would apply with respect to the detours supplementing the traditional rules of cribbage as heretofore described with reference to the Golfers Cribbage game above. Furthermore, other supplemental rules characteristic of slalom or giant slalom skiing may be included for earning bonus points or suffering penalty points analogous to the supplemental rules described above with reference to the Golfers Cribbage game. A similar Skiers Cribbage game is provided for cross country skiers using a gameboard with the graphic representation of a cross country skiing course with skiing obstacles and hazards characteristic of cross country skiing coinciding with the detours, etc. For the Skiers Cribbage games, the scoring pegs may be miniature ski poles.

By way of another example the invention contemplates a Yachters Cribbage game for sailing yachts over a race course. According to this example, the gameboard is formed with the graphic representation of a yacht racing course. The rows of pegholes comprise tracks following the racing course and may be divided into sections coinciding with the legs of the race course. Furthermore, a particular leg may be subdivided into zig-zag subsections representing beating upwind. For sailing obstacles and hazards the invention contemplates a variety of detours coinciding with such sailing obstacles and hazards as missing a buoy, contact penalty, man overboard, becalmed "in irons", premature crossing of the starting line, split or torn sail, failure to yield right of way, etc. In each instance, the detour from a sailing obstacle peghole introduces off-track pegholes retarding progress through the race course in the manner heretofore described. Yachting pennants may be used for scoring pegs. Supplemental rules characteristic of yacht sailing and racing specify conditions for awarding bonus points or subtracting penalty points.

It is apparent that the invention is applicable to a variety of sporting cribbage games. The gameboard can also be incorporated into a table top or be formed as a table top to provide a gaming table. While the invention has been described with reference to particular example embodiments, it is intended to cover all variations and equivalents within the scope of the following claims.

We claim:

1. An improved cribbage game using a cribbage gameboard formed with at least two rows of a specified number of cribbage scoring pegholes for respectively scoring the points earned from play of cribbage card hands by at least two players, and pegs for tallying said points on the gamebaord by counting cribbage scoring pegholes and moving pegs along respective rows of cribbage scoring pegholes according to said earned points until one of the players earns 121 points thereby winning the game, the improvement comprising:

said cribbage gameboard being formed with the graphic representation thereon of a sporting course for a selected sport, said rows of cribbage scoring pegholes comprising non-linear tracks following the course, each track comprising a separate identifiable continuous sequence delineated by gameboard indicia from the beginning to the end of the sporting course, each track comprising 121 cribbage scoring holes for scoring and tallying points from the beginning to the end of the cribbage game, said rows through the course comprising a plurality of detours from the tracks, each detour starting from a sporting obstacle cribbage scoring peghole delineated by gameboard indicia on the track and terminating at a return cribbage scoring peghole on the track with at least one additional off-track peghole in between, said off-track peghole delineated by gameboard indicia, said gameboard being formed with graphic representations of sporting obstacles or hazards characteristic of the selected sport coinciding with said detours, thereby adding additional off-track pegholes to the course followed by the pegs of players and retarding progress of the pegs through the gameboard when the pegs stop in a sporting obstacle cribbage scoring peghole after scoring and tallying the points earned from a play of a cribbage card hand;

and a set of supplemental sporting rules supplementing the rules of cribbage, said set of supplemental sporting rules being characteristic of the selected sport and specifying that players must follow a detour when pegs of players stop in a sporting obstacle cribbage scoring peghole upon scoring and tallying the points earned from play of a cribbage card hand, and that a player who first completes a respective track of 121 cribbage scoring pegholes through the course wins the cribbage game.

2. An improved cribbage game using a cribbage gameboard formed with at least two rows of a specified number of cribbage scoring pegholes for respectively scoring the points earned from play of cribbage card hands by at least two players, and pegs for tallying said points on the gameboard by counting cribbage scoring pegholes and moving pegs along respective rows of cribbage scoring pegholes according to said earned points until one of the players earns 121 points thereby winning the cribbage game, the improvement comprising:

said cribbage gameboard being formed with the graphic representation thereon of a golf course comprising a plurality of sequential fairways each beginning with a tee and culminating in a green formed with a single golf hole, said rows of cribbage scoring pegholes comprising non-linear tracks following the sequential fairways through the golf course, each track comprising a separate identifiable continuous sequence of cribbage scoring pegholes delineated by gameboard indicia through the cribbage gameboard from a starting peghole delineated by gamebaord indicia beginning at the tee of the first fairway to a game completion peghole delineated by gameboard indicia at the end of the last fairway, each track comprising 121 cribbage scoring pegholes for scoring and tallying points from the beginning to the end of the cribbage game, said game completion peghole comprising the 121st cribbage scoring peghole for each track, each track being divided into fairway track sections by gamebaord indicia, each track section beginning with a peghole at a tee, then following sequential cribbage scoring pegholes through the fairway, and having the respective golf hole of the green as the last cribbage scoring peghole of a fairway track section, said tracks merging at the single golf hole of the green of each fairway and then dividing again into separate tracks at the tee of the next fairway, said rows through the golf course further comprising a plurality of detours from the tracks, each detour starting from a golfing obstacle cribbage scoring peghole delineated by gameboard indicia on the track and terminating at a return cribbage scoring peghole on the track with at least one additional off-track peghole in between, said off-track pegholes being delineated by gameboard indicia including indicia defining a path to the return cribbage scoring peghole, merging with the track, said gameboard being formed with graphic representations of golfing obstacles or hazards coinciding with said detours, thereby adding additional off-track pegholes to the course followed by the pegs of players and retarding progress of the pegs through the gameboard when the pegs stop in a golfing obstacle cribbage scoring peghole after scoring and tallying the points earned from a play of a cribbage card hand;

and a set of supplemental golfer's rules supplementing the rules of cribbage, said set of supplement golfer's rules specifying that players must follow a detour when pegs of players stop in a golfing obstacle cribbage scoring peghole upon scoring and tallying the points earned from play off of a cribbage card hand, and that a player who first completes a respective track of 121 cribbage scoring pegholes through the golf course wins the cribbage game.

3. The improved cribbage game of claim 2 wherein the gameboard comprises graphic representations of golfing hazards and obstacles in the form of sand traps and water hazards, said detours coinciding with said graphic representations.

4. The improved cribbage game of claim 2 wherein the gameboard comprises graphic representations of further golfing hazards and obstacles in the form of golf ball in-the-rough and missed puts, said detours also coinciding with said further golfing hazards and obstacles.

5. The improved cribbage game of claim 2 wherein the gameboard comprises graphic representations of further golfing hazards and obstacles including trees, said detours also coinciding with said further golfing hazards and obstacles.

6. The improved cribbage game of claim 2 wherein the set of supplemental golfer's rules specify that a player automatically scores a bonus point, deemed a birdie, and advances the peg to the tee of the next fairway section if the peg of a player stops in a golf hole upon scoring and tallying the points earned from play of a cribbage card hand.

7. The improved cribbage game of claim 6 wherein the set of supplemental golfer's rules specify that if a player earns no points from play of a cribbage card hand, the players receives two negative penalty points, deemed a lost ball, and the peg of the player must be moved two pegholes back.

8. The improved cribbage game of claim 2 wherein the gameboard comprises at least one detour in each fairway section of a track.

9. The improved cribbage game of claim 2 wherein the golf course comprises a nine-hole golf course with nine fairway sections.

10. The improved cribbage game of claim 9 wherein the set of supplemental golfer's rules specify that if a player has not reached the tee of the eighth fairway section when his opponent wins the game then he is deemed skunked, designated a duffer, and is scored as losing two games.

11. The improved cribbage game of claim 10 wherein the set of supplemental golfer's rules specify that if a player has not reached the tee of the sixth fairway section when his opponent wins the game then he is double skunked, designated a double duffer, and is scored as losing three games.

12. The improved cribbage game of claim 2 wherein the gameboard comprises graphic representations of golfing hazards in the form of sand traps, water hazards, trees, golf-balls-in-the-rough, and missed putts, said detours coinciding with said golfing hazards and obstacles, and wherein at lest one detour is provided in each fairway section of a track.

13. The improved cribbage game of claim 12 wherein each track comprises an equal number of detours and holes.

14. The improved cribbage game of claim 2 wherein the pegs comprise golf tees.

15. The improved cribbage game of claim 2 wherein each track comprises 121 pegholes and wherein the detours add additional pegholes in the course for players whose pegs stop in golfing obstacle pegholes upon scoring and tallying the points earned from play of a cribbage card hand.

16. The improved cribbage game of claim 15 wherein the golfing obstacle cribbage scoring pegholes are designated by one color and the golf holes on each respective green are designated by another color.

17. The improved cribbage game of claim 2 wherein the graphic representation of the golf course depicts the likeness and landscape characteristics of an actual selected golf course.

18. The improved cribbage game of claim 2 wherein the gameboard comprises a table top.

19. An improved cribbage game using a cribbage gameboard formed with at least two rows of a specified number of cribbage scoring pegholes for respectively scoring the points earned from play of cribbage card hands by at least two players, and pegs for tallying said points on the gameboard by counting cribbage scoring pegholes and moving pegs along respective rows of said pegholes according to said earned points until one of the players earns 121 points thereby winning the cribbage game, the improvement comprising:

said cribbage gameboard being formed with the graphic representation thereon of a golf course comprising a plurality of sequential fairways each beginning with a tee and culminating in a green formed with a single golf hole, said rows of cribbage scoring pegholes comprising non-linear tracks following the fairways through the golf course, each track defining a separate identifiable continuous sequence of cribbage scoring pegholes delineated by gameboard indicia through the gamebaord from a starting peghole delineated by gameboard indicia at the tee of the first fairway to a game completion peghole delineated by gameboard indicia at the end of the last fairway, each track comprising 121 cribbage scoring pegholes for scoring and tallying points from the beginning to the end of the cribbage game, said game completion peghole comprising the 121st cribbage scoring peghole, each track being divided into fairway track sections by gameboard indicia, each track section beginning with a peghole at the tee, then following sequential cribbage scoring pegholes through the fairway, and having the respective golf hole of the green as the last cribbage scoring peghole of a fairway track section, said tracks merging at the single golf hole of the green of each fairway and then dividing again into separate tracks at the tee of the next fairway, said rows through the golf course further comprising a plurality of detours from the tracks, at least one detour in each fairway section, each detour starting from a golfing obstacle cribbage scoring peghole delineated by gameboard indicia on the track and terminating at a return cribbage scoring peghole on the track with at least one additional off-track peghole in between, said off-track peghole being delineated by gameboard indicia including indicia defining a path to the return cribbage scoring peghole merging with the track, said gameboard being formed with graphic representations of golfing obstacles or hazards coinciding with said detours, said graphic representations of golfing hazards and obstacles being in the form of sand traps, water hazards, trees, golf-balls-in-the-rough, and missed putts, thereby adding additional pegholes to the course followed by the pegs of players and retarding progress of the pegs through the gameboard when the pegs stop in a golfing obstacle peghole after scoring and tallying the points earned from play of a cribbage card hand;

said pegs comprising golftees;

and a set of supplemental golfer's rules supplementing the rules of cribbage, said set of supplemental golfer's rules specifying that players must follow a detour when pegs of players stop in a golfing obstacle cribbage scoring peghole upon tallying the points earned from play of a cribbage card hand, and that a player who first completes a respective track through the golf course wins the game, said set of supplemental golfer's rules further specifying that a player automatically scores a bonus point, deemed a birdie, and advances the peg to the tee of the next fairway section if the peg stops in a golf hole of a green upon scoring and tallying the points earned from play of a cribbage card hand and that if a player earns no points in play of a cribbage card hand then the player receives at least one negative penalty point, deemed a lost ball, and the peg of the player must be moved back at least one cribbage scoring peghole.

20. The improved cribbage game of claim 19 wherein each track comprises 121 cribbage scoring pegholes and the detours add additional pegholes in the course for players whose pegs stop in golfing obstacle cribbage scoring pegholes upon scoring and tallying the points earned from play of a cribbage card hand, and wherein the graphic representation of the golf course depicts the likeness and landscape characteristics of an actual selected golf course.

* * * * *